US007375317B2

(12) United States Patent
Zhang

(10) Patent No.: US 7,375,317 B2
(45) Date of Patent: May 20, 2008

(54) ION DRIFT-CHEMICAL IONIZATION MASS SPECTROMETRY

(75) Inventor: Renyi Zhang, College Station, TX (US)

(73) Assignee: The Texas A&M University System, College Station, TX (US)

( * ) Notice: Subject to any disclaimer, the term of this patent is extended or adjusted under 35 U.S.C. 154(b) by 357 days.

(21) Appl. No.: 11/193,560

(22) Filed: Jul. 29, 2005

(65) Prior Publication Data

US 2006/0022132 A1 Feb. 2, 2006

Related U.S. Application Data

(66) Substitute for application No. 60/598,188, filed on Aug. 2, 2004.

(51) Int. Cl.
*H01J 49/40* (2006.01)
*G01N 27/64* (2006.01)

(52) U.S. Cl. ..... 250/287; 250/282

(58) Field of Classification Search ..... 250/288, 250/281, 423 P, 440.11
See application file for complete search history.

(56) References Cited

U.S. PATENT DOCUMENTS

| | | | | |
|---|---|---|---|---|
| 5,382,793 | A * | 1/1995 | Weinberger et al. | 250/288 |
| 5,594,243 | A * | 1/1997 | Weinberger et al. | 250/288 |
| 5,789,747 | A * | 8/1998 | Kato et al. | 250/292 |
| 7,015,462 | B2 * | 3/2006 | Karas | 250/287 |
| 2004/0178340 | A1 * | 9/2004 | Karas | 250/282 |

* cited by examiner

*Primary Examiner*—Nikita Wells
*Assistant Examiner*—Johnnie L Smith, II
(74) *Attorney, Agent, or Firm*—Conley Rose, P.C.

(57) ABSTRACT

A method and apparatus for conducting mass spectrometry. The mass spectrometry may be accomplished by ion drift-chemical ionization mass spectrometry. One embodiment includes a chemical ionization mass spectrometer comprising an ion drift zone having an ion conductor that transports positive or negative ions. The chemical ionization mass spectrometer further comprises an ion source that produces the positive or negative ions and a mass spectrometer.

28 Claims, 6 Drawing Sheets

ION DRIFT-CHEMICAL IONIZATION MASS SPECTROMETRY

CROSS-REFERENCE TO RELATED APPLICATIONS

This non-provisional application claims the benefit of U.S. Provisional Application No. 60/598,188, filed Aug. 2, 2004, which is hereby incorporated by reference in its entirety.

STATEMENT REGARDING FEDERALLY SPONSORED RESEARCH OR DEVELOPMENT

This invention was made with Government support under Contract No. R03-0132 awarded by the U.S. Environmental Protection Agency (EPA). The government has certain rights in this invention. This work was also supported by the Robert A. Welch Foundation under contract A-1417 and the Houston Advanced Research Center (HARC) under contract H-25-2004C2.

BACKGROUND OF THE INVENTION

1. Field of the Invention

This invention relates to the field of mass spectrometry and more specifically to the field of chemical ionization mass spectrometry.

2. Background of the Invention

Chemical ionization mass spectrometry has been developed for use in laboratory and field trace gas measurements. Such mass spectrometry typically involves ionization of a neutral species by a reagent ion to yield a product ion. The product ion may be analyzed by a quadrupole mass analyzer for species identification and abundance determination.

One type of chemical ionization mass spectrometry is proton transfer-reaction mass spectrometry (PTR-MS), which has been developed for online quantification of volatile organic compounds in air, among other applications. Proton transfer-reaction mass spectrometry involves proton-transfer reactions with hydronium ions ($H_3O^+$) to ionize volatile organic compounds. The resulting protonated product ion is then detected by mass spectrometry. For instance, volatile organic compounds directly emitted from natural and anthropogenic sources in the air as well as their oxidation products may be quantified simultaneously by proton transfer-reaction mass spectrometry. A drawback to proton transfer-reaction mass spectrometry includes that it measures species based on hydronium ions, which considerably narrows the scope of applications. Further drawbacks include that other desired species may not react with hydronium ions, which may result in the failure to detect species. A drawback for other types of conventional chemical ionization mass spectrometry includes the typical need to calibrate the mass spectrometer with gas standards to quantify the species. Certain gas standards are not commercially available because of difficulties in synthesizing the species.

Consequently, there is a need for an improved method and apparatus for mass spectrometry. In addition, there is a need for improving chemical ionization mass spectrometry to reduce the non-detection of species. Further needs include an improved apparatus and method for quantifying species.

BRIEF SUMMARY OF SOME OF THE PREFERRED EMBODIMENTS

These and other needs in the art are addressed in one embodiment by an ion drift-chemical ionization mass spectrometer. The ion drift-chemical ionization mass spectrometer comprises an ion drift zone having an ion conductor that transports positive or negative ions. In addition, the ion drift-chemical ionization mass spectrometer comprises an ion source that produces positive or negative ions and a mass spectrometer.

In another embodiment, these and other needs in the art are addressed by a method of ion drift-chemical ionization mass spectrometry. The method comprises introducing a gas feed to the ion drift zone, wherein the gas feed comprises a neutral species (e.g., one or more neutral species). The method further comprises providing positive or negative reagent ions to the ion drift zone. In addition, the method comprises contacting the reagent ions with the gas feed to allow the neutral species to react with the reagent ions to produce product ions. The method also comprises guiding the reagent and product ions through an electrical field and performing mass spectrometry on the reagent and product ions. The method may also comprise quantification of the neutral species without calibration with gas standards.

The ion drift-chemical ionization mass spectrometer and method of ion drift-chemical ionization mass spectrometry overcome problems with conventional chemical ionization mass spectrometry. For instance, the ion drift-chemical ionization mass spectrometer and such method may detect species that are not reacting with hydronium ions. In addition, such an apparatus and method may quantify species without calibration with a gas standard that is typically performed for conventional chemical ionization mass spectrometer.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
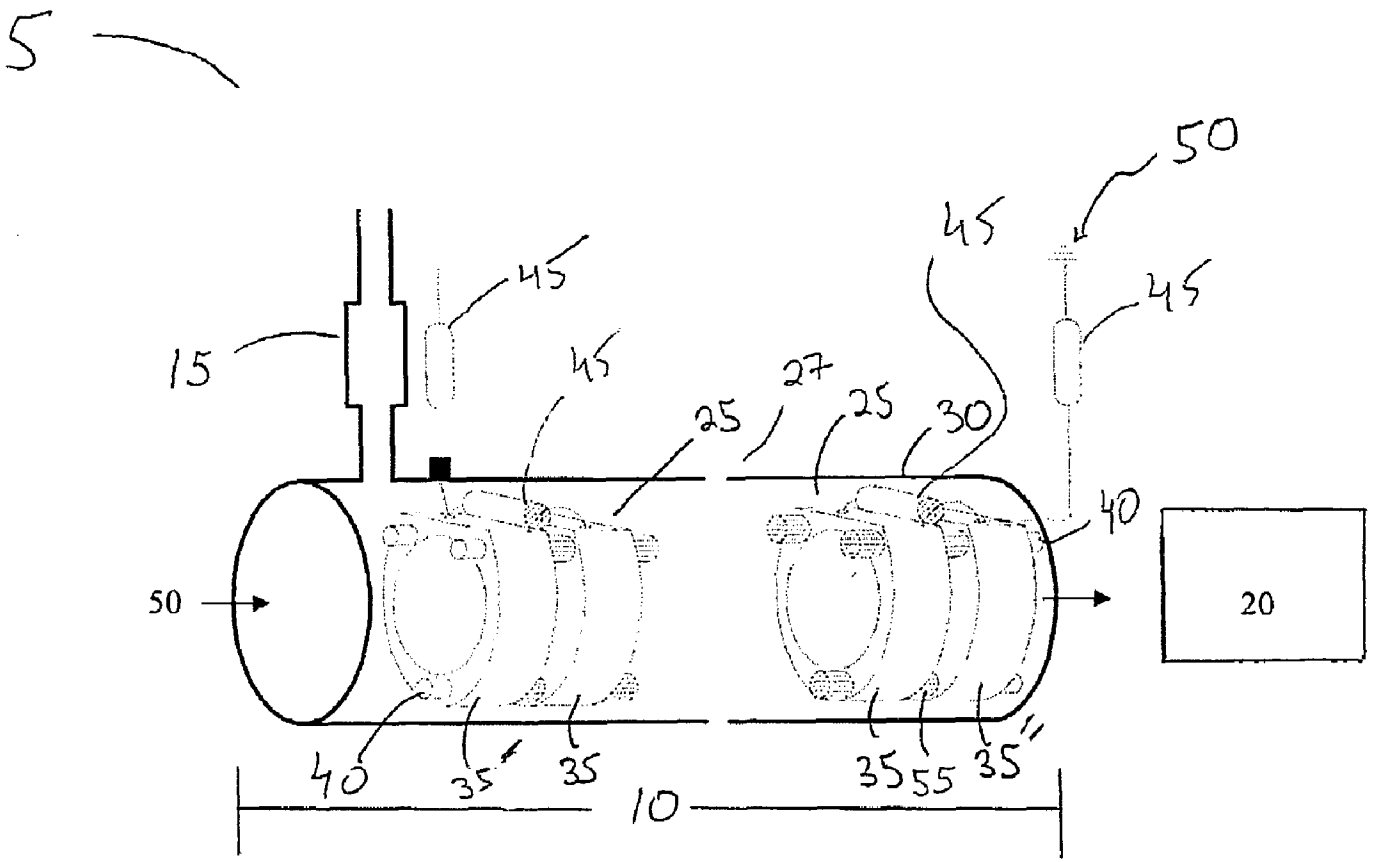
FIG. 1 illustrates an ion drift-chemical ionization mass spectrometer.

FIG. 1 illustrates an ion drift-chemical ionization mass spectrometer 5. Ion drift-chemical ionization mass spectrometer 5 comprises an ion drift zone 10, an ion source 15, and a mass spectrometer 20. Ion drift zone 10 may comprise an ion conductor 25 and an outer enclosure 30. Ion conductor 25 includes a series of parallel and isolated conducting electrodes (35, 35', 35") and is enclosed by outer enclosure 30 to provide an environment for vacuum conditions. Ion drift zone 10 may have any size and shape suitable for an ion-molecule reaction to occur. Without limitation, examples of suitable shapes for ion drift zone 10 (e.g., the outer enclosure 30 portion) include a tubular shape (as illustrated in FIG. 1), an elongated rectangular shape, and the like. In an embodiment, ion drift zone 10 may comprise a tubular shape. Outer enclosure 30 may be composed of any suitable material. For instance, non-limiting examples of suitable materials include Pyrex glass, ceramic, or other non-conductive materials.

Ion conductor 25 has terminal electrodes 35', 35" and internal electrodes 35. It is to be understood that ion drift-chemical ionization mass spectrometer 5 as illustrated in FIG. 1 has breaks 27 for illustration purposes only. Breaks 27 indicate drafter's license to show that ion drift-chemical ionization mass spectrometer 5 may have more internal electrodes 35 than illustrated. However, it is to be further understood that ion conductor 25 is not limited to having more electrodes 35 than illustrated but instead may have any desired number of electrodes. In an embodiment, ion conductor 25 has one or more than one electrode, alternatively at least 10 electrodes. The electrodes 35, 35', 35" may comprise any suitable electrically conductive material, alternatively any electrically conductive and inert material. Without limitation, examples of suitable materials include stainless steel, copper, other metals, or combinations thereof; alternatively stainless steel. The electrodes 35, 35', 35" may have an inner opening of suitable size for applying an electrical field and for guiding the ionized species in ion drift zone 10. In an embodiment in which ion drift zone 10 has more than one electrode, the electrodes may be connected in series. In an embodiment, the electrodes have a ring-like shape. For instance, ion drift zone 10 may have a series of electrodes having ring-like shapes connected in series, as shown in FIG. 1. The electrodes may have any suitable inside diameter through which ions may flow.

As illustrated in FIG. 1, ion conductor 25 may be physically supported by supports 40, which are secured to electrodes 35' and 35" and mounted within ion drift zone 10. Supports 40 may be mounted within ion drift zone 10 by any suitable method. In addition, supports 40 may have any suitable shape for physically supporting ion conductor 25 such as, without limitation, by rods, bars, and the like. In alternative embodiments (not illustrated), supports 40 may also be disposed between internal electrodes 35.

As further illustrated in FIG. 1, ion drift zone 10 may have resistors 45 disposed between electrodes (e.g., between electrodes 35' and 35). Resistors 45 may have any resistance suitable for controlling an applied current through an electrode. For instance, resistors 45 may have a resistance from about 1 MΩ to about 10 MΩ, alternatively from about 10 Ω to about 1,000Ω, and alternatively about 1-MΩ. As illustrated in FIG. 1, an embodiment includes ion drift-chemical ionization mass spectrometer 5 having one resistor 45 for each electrode 35, 35', 35". Resistor 45 may be mounted between each electrode. In addition, a resistor 45 may be disposed between ion source 15 and the electrode (electrode 35') nearest ion source 15, and a resistor 45 may be disposed between the electrode (electrode 35") nearest ground 50. Ground 50 may comprise any suitable grounding method for grounding ion conductor 25. It is to be understood that ion drift-chemical ionization mass spectrometer 5 is not limited to the resistors 45 as shown in FIG. 1 but may have any desirable number of resistors 45. In addition, alternative embodiments may also include any disposition of resistors 45 suitable for providing a desired resistance to ion conductor 25.

Ion conductor 25 may also have spacers 55 disposed between the electrodes 35, 35', 35". Without being limited by theory, spacers 55 insulate electrodes 35, 35', 35" to make each electrode electrically non-conductive to each other. Spacers 55 may be any inert, non-conductive material such as, without limitation, TEFLON coating (which is a polytetrafluoroethylene coating commercially available from DuPont), nylon, ceramic, and the like. Spacers 55 may have any shape suitable for making each electrode electrically non-conductive to another electrode. Without limitation, examples of such suitable shapes include rods, tubes, and the like. Spacers 55 may also provide support for electrodes in ion conductor 25. Spacers 55 may be horizontally mounted between each electrode. In alternative embodiments (not illustrated), spacers 55 may be mounted in any other suitable position for physically supporting the electrodes. In other alternative embodiments (not illustrated), ion conductor 25 comprises no spacers 55. In further alternative embodiments (not illustrated), ion conductor 25 comprises one or more spacers 55 but does not have spacers 55 between each electrode. Instead, ion conductor 25 has at least one spacer 55 between one or more electrodes but not between each electrode.

Ion source 15 may be any source suitable for providing positive and/or negative ions. Without limitation, examples of suitable ion sources include a glow discharge device, radioactive polonium $^{210}$Po, and an electron gun. Ion source 15 may be applied by a suitable positive or negative charge. For instance, a positive charge may be from about 10V to about 1,000V, alternatively from about 1 kV to about 5 kV, and alternatively from about 1 kV to about 2 kV, and further alternatively about 5 kV. A negative charge may be from about −10V to about −1,000V, alternatively from about −100V to about −5 kV, and alternatively from about −1 kV to about −2 kV, and further alternatively about −5 kV.

Mass spectrometer 20 may be any mass spectrometer suitable for identifying and quantifying species. Without limitation, an example of a mass spectrometer is a quadrupole mass spectrometer. A commercial example of a suitable mass spectrometer is the QC-150 mass spectrometer, which is commercially available from Extrel CMS.

The following describes an application of ion drift-chemical ionization mass spectrometer 5 as illustrated in FIG. 1. For instance, an embodiment includes introducing a gas feed 50 to ion drift-chemical ionization mass spectrometer 5. Gas feed 50 comprises a gas or mixture having various neutral species. Without limitation, examples of suitable gases include air, synthesized gas mixtures, and the like. The air may be ambient air or pressured air. A neutral species refers to an organic or inorganic compound. In an embodiment, the neutral species is the species to be analyzed (e.g., detected and quantified) by ion drift-chemical ionization mass spectrometer 5. Without limitation, examples of suitable neutral species include natural gas, aromatic compounds, hydrocarbons, volatile organic compounds, nitrogen-containing compounds, sulfur-containing compounds, and the like. Gas feed 50 may be introduced to ion drift-chemical ionization mass spectrometer 5 by applying a pressure gradient in ion drift zone 10. The pressure gradient may be any pressure suitable for drawing gas feed 50 in to ion drift zone 10. In one embodiment, a pump (not illustrated) may provide the pressure gradient. The pump may be any pump (e.g., mechanical pump) suitable for providing a pressure to ion drift zone 10 that is suitable for drawing gas feed 50 in to ion drift zone 10. The pressure in ion drift zone 10 may be from about 0.5 torr to about 10 torr, alternatively from about 1 torr to about 4 torr.

As further illustrated in FIG. 1, ion source 15 provides a positive and/or negative charge to a gas. Ion source 15 may constantly provide the charge while gas feed 50 is being introduced to ion drift zone 10. In an alternative embodiment, the charge is intermittently provided while gas feed 50 is being introduced to ion drift zone 10. Ion source 15 produces reagent ions. For instance, in an embodiment in which volatile organic compounds are to be analyzed, a gas such as ambient air may be introduced to ion source 15 with a positive voltage applied producing $H_3O^+$ reagent ions. In an embodiment in which $HNO^3$ is to be analyzed, ion source 15 may produce $SiF_5^-$ reagent ions with a negative voltage. Without being limited by theory, the production of the negative or positive reagent ions is facilitated by the sources of the ions. The reagent ions are guided to ion drift zone 10 by a suitable charge applied to ion source 15, with the potential gradient between the two adjustable by a resistor (e.g., resistor 45 disposed between internal electrode 35' and ion source 15). A trace gas may be introduced through ion source 15 to produce the suitable reagent ion. The trace gas may be any gas suitable for producing ions. For instance, the trace gas may be $SF_6$ and $SiF_4$ to produce $SiF_5^-$ ions, with the ion source charged negatively. In addition, a trace amount of water may be introduced through ion source 15 to produce $H_3O^+$, with the ion source charged positively.

The reagent ions produced by ion source 15 flow into ion drift zone 10 and mix with gas feed 50. A chemical ionization reaction occurs between the neutral species in gas feed 50 and the reagent ions to produce product ions. For instance, the reagent ions can be $H_3O^+$ for detection of volatile organic compounds or $SiF_5^-$ for detection of $HNO_3$. Without being limited by theory, the neutral species chemically ionize into positive or negative product ions with a controlled ion-molecule reaction. The time of the ion-molecule reaction may be controlled by the electrical field and flow velocity in ion drift zone 10. In an embodiment, the time may be from 10 ms to 100 ms. The reagent and product ions and gas feed 50 may flow through ion drift zone 10. A voltage may be applied to the electrodes (e.g., electrodes 35, 35', 35") to guide such ions through ion drift zone 10. Without being limited by theory, the voltage controls the ion velocity and prevents loss of ions by guiding the ions through ion drift zone 10. It is to be understood that by controlling the ion velocity, the ion-molecule reaction may also be controlled. The voltage may be from about 100V to about 5 kV for positive ions, alternatively from about −5V to about −5 kV for negative ions. A portion or all of the reagent and product ions and gas feed 50 flow into mass spectrometer 20. In an embodiment, a divider (not illustrated) is disposed between mass spectrometer 20 and ion drift zone 10. The divider may have any suitable configuration for separating mass spectrometer 20 from ion drift zone 10 and for allowing a portion of the flow of ions and gas to pass therethrough. The divider may comprise an electrically conductive material such as, without limitation, stainless steel, copper, and the like. In an embodiment, the divider has an aperture (not illustrated), which may have a small diameter to provide a sufficient pressure gradient between mass spectrometer 20 and ion drift zone 10. The pressure gradient may be sufficient to allow the flow of ions and gas feed 50 into mass spectrometer 20. In some embodiments, the pressure gradient may be from about 2 torr to about $10^{-5}$ torr, alternatively from about 4 torr to about $10^{-6}$ torr. The aperture may have a diameter between about 10 μm and about 500 μm, alternatively between about 20 μm and about 1,000 μm. In an embodiment, the divider has a sufficient charge to further focus the ions to flow through the aperture. For instance, the charge may be from about −500 volts to about 0 volts for negative ions, alternatively from about 0 volts to about 500 volts. In an alternative embodiment, the divider may be electrically insulated from mass spectrometer 20 by any suitable means such as by an o-ring, gasket, or the like.

As further illustrated in FIG. 1, a portion of the flow enters mass spectrometer 20, and the reagent and product ions are analyzed. Analyzation may identify the presence and quantity (e.g., abundance) of the neutral species.

The following reaction (1) illustrates the basic ion-molecule reaction in the chemical ionization reactions.

$$A^{(+\ or\ -)}+X\rightarrow X'^{(+\ or\ -)}+\text{others},\ k_1 \tag{1}$$

In reaction (1), A represents the ions produced by ion source 15 with the + or − representing the charge sign of the ion; X represents the neutral species; X' represents the product ions produced by the reaction with + or − representing the charge sign of the ion; $k_1$ represents the rate of reaction; and others represents other possible products of the reaction, fragments of X, and the like.

The abundance of the neutral species (X) may be determined from the following equation (2).

$$[X]=[X']/(k_1[A]\Delta t) \tag{2}$$

In equation (2), A represents the abundance of the ions produced by ion source 15, X represents the abundance of the neutral species, X' represents the abundance of the product ions produced by the reaction (e.g., reaction (1)), $k_1$ represents the rate of reaction, and Δt represents the time of the ion-molecule reaction in ion drift zone 10 between the ions (A) and the neutral species (X). Without being limited by theory, equation (2) allows for quantification of the gas phase concentrations (e.g., concentrations of the neutral species in gas feed 50) without calibration with gas standard. $K_1$ may be experimentally or theoretically determined by any suitable method. Methods for experimentally determining ion-molecule rates of reaction are disclosed in Hinojosa et al., J. Phys. D: Appl. Phys. 2003, 36, 2510-2514 and Zhao and Zhang, Atmos. Environ., 2004, 38, 2177-2185, which are hereby incorporated by reference in their entirety. X' and A are measured by mass spectrometer 20. Δt may be determined from the following equation (3).

$$\Delta t=l/U_t \tag{3}$$

In equation (3), l represents the length of ion drift zone 10, $U_t$ represents the total velocity of the product ions (X'). $U_t$ may be determined from the following equation (4).

$$U_t=U_i+U_f \tag{4}$$

In equation (4), $U_i$ represents the ion drift velocity in ion drift zone 10, and $U_f$ represents the flow velocity of the neutral species (X) in ion drift zone 10. $U_i$ may be determined from the following equation (5).

$$U_i=\mu E \tag{5}$$

In equation (5), μ represents the ionic mobility of the product ions, and E represents the voltage gradient in ion drift zone 10. The voltage gradient, calculated from the voltage difference between the first and last electrodes in ion drift zone 10 (e.g., electrodes 35' and 35" as illustrated in FIG. 1), may be measured by any suitable method. μ may be determined by the following equation (6).

$$\mu=\mu_0(760/P)(T/273) \quad (6)$$

In equation (6), P represents the pressure in ion drift zone 10, T represents the temperature in drift zone 10, and $u_0$ represents the reduced ionic mobility. $u_0$ is a known constant. For instance, $u_0$ is disclosed in Dotan et al., J. Chem. Phys. 1976, 65, 5028-5030, which is hereby incorporated by reference in its entirety. It is to be understood that the numerals 760 and 273 in equation (6) represent conversion from the appropriate units to standard pressure and temperature, respectively, but equation (6) may not need such conversion numerals 760 and 273 if such units are in standard pressure and temperature units.

$U_f$ may be determined by any suitable method. For instance, methods for determining $U_f$ are disclosed in Zhang et al., J. Geophys. Res. 2000, 105, 24627-24635, which is hereby incorporated by reference in its entirety.

In an alternative embodiment (not illustrated), ion drift-chemical ionization mass spectrometer 5 further includes a flow tube through which gas feed 50 flows prior to entering ion drift zone 10. In such an alternative embodiment, gas feed 50 is mixed with a carrier gas and then drawn in to ion drift zone 10. The carrier gas may comprise any suitable carrier gas for use in gas chromatography.

To further illustrate various illustrative embodiments of the present invention, the following example is provided.

EXAMPLE

Figure 2:
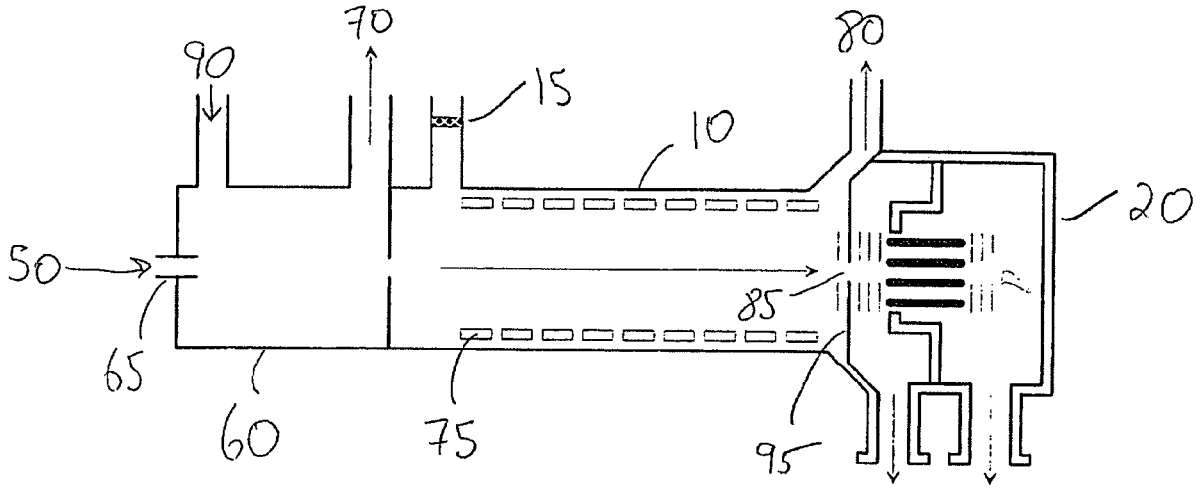
FIG. 2 illustrates an ion drift-chemical ionization mass spectrometer having a flow tube.

To demonstrate a method for using ion drift-chemical ionization mass spectrometry to identify isoprene ($C_5H_8$) and nitric acid ($HNO_3$), an ion drift-chemical ionization mass spectrometer as illustrated in FIG. 2 was used. The ion drift-chemical ionization mass spectrometer included an ion source 15 to produce positive or negative reagent ions, a drift tube 10 where the ion-molecule reaction takes place, and a quadrupole mass spectrometer 20 where the reagent ions are analyzed.

A flow tube 60 was connected to an ion drift-chemical ionization mass spectrometer for laboratory measurements and calibrations, and an inlet 65 was used. The flow tube 60 was a Pyrex tubing 70 cm in length and 2.25 cm ID. A coating of halocarbon wax was applied to the inner walls of the flow tube 60 to reduce wall loss. The majority of the gases in the flow tube 60 were diverted into a mechanical pump 70 at the downstream end of the flow tube 60 while only a small amount (~1%) of the total flow passed through a 1 mm pinhole into the drift tube region 10. The pressure in the flow tube 60 was maintained at about 100 Torr.

The ion source 15 was a custom-made glow discharge device. For VOC detection, ambient air flowed through the discharge, and a positive voltage between 1 to 2 kV was applied to the electrode in the discharge producing $H_3O^+$ ions. For $HNO_3$ detection, nitrogen flowed through the discharge mixed with $SF_6$ at the ppm level, and a negative voltage (−5 kV) was applied to the electrode producing $SF_6^-$ ions.

The drift tube 10 was constructed of a 9.5 cm length Pyrex tube that contained a set of 10 stainless steel rings 75 connected in series with 1 MΩ resistors between rings 75. The rings 75 had an ID of 1.4 cm through which the flow passed. The chemical ionization reactions between the reagent ion and the neutral compound to be detected and quantified occurred in this region. A voltage was applied to the rings 75 to enhance the ion flow. At the downstream end of the drift tube 10, the majority of the flow was diverted into a pump 80 while a small portion of the flow passed through an aperture 85 (0.2 mm) into the mass spectrometer 20 (Extrel QC-150). The aperture 85 was slightly biased (0 to 10 V) for ion-tuning purposes, and the polarity was dependent on the polarity of the reagent ions produced. The pressure in the drift tube 10 was regulated between 1 and 4 Torr.

The sampled ions were focused with an ion optics, analyzed with a quadrupole mass filter, and detected by an electron multiplier. The multiplier was connected with a preamplifier, which converted the raw signal into pulsed TTL (transistor-to-transistor logic) signals allowing them to be processed by a personal computer.

For the reaction between $H_3O^+$ and isoprene, our observation showed that other ionic products were formed, dependent on the E/N ratio where E is the electric gradient (V $cm^{-1}$) and N is the number concentration of the buffer gas (molecule $cm^3$). A considerable peak at mass 39 was observed and a significant peak at mass 67 was also obtained at an E/N ratio larger than 140 Td (1 Td=$10^{17}$ V $cm^2$ $molecule^{-1}$) when using air as the carrier gas. These two mass peaks increased when a higher E/N ratio was applied. This implied that there are three possible channels for the reaction between $H_3O^+$ and isoprene at high E/N ratios, $$\begin{aligned} C_5H_8 + H_3O^+ &\rightarrow C_5H_9^+ + H_2O \\ &\rightarrow C_5H_7^+ + H_2 + H_2O \\ &\rightarrow C_3H_3^+ + C_2H_6 + H_2O. \end{aligned}$$

Figure 3:
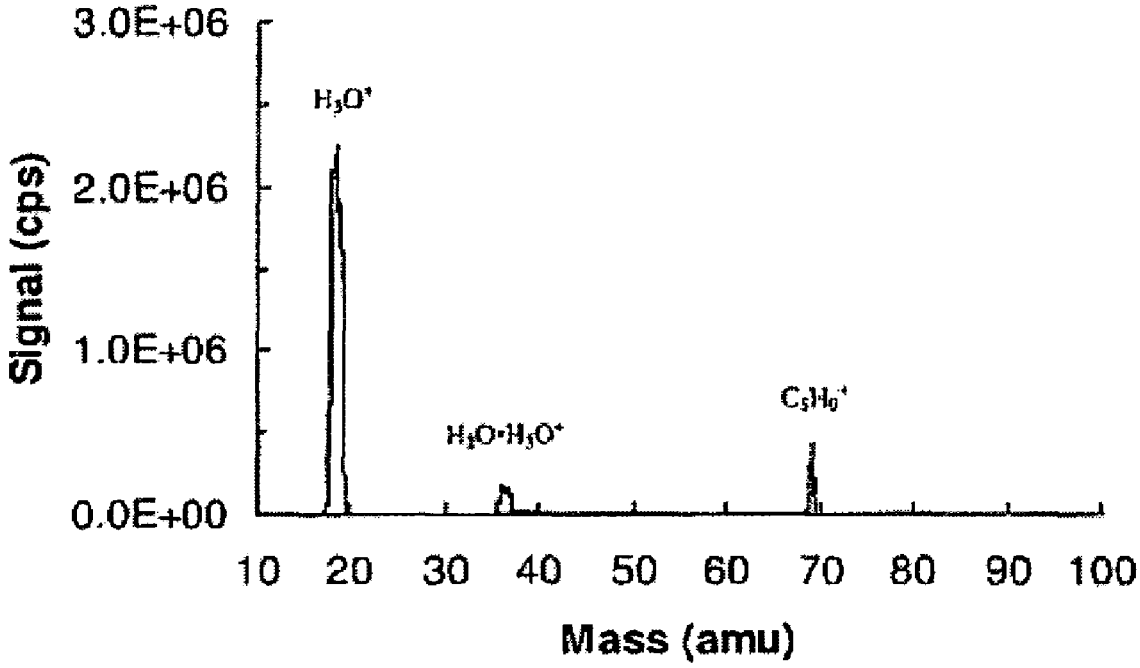
FIG. 3 illustrates a spectral scan for an isoprene analysis.

Therefore, a proper E/N ratio was chosen in order to inhibit the dissociation of the protonated isoprene and assure the major channel for the desired proton transfer reaction. The E/N ratio was maintained at about 100 Td, which greatly prevented the protoned isoprene from being dissociated while the water clusters were effectively minimized. FIG. 3 shows the spectra scan from 10 to 100 amu. The three peaks at mass 19, 37 and 69 correspond to $H_3O^+$, $H_3O.H_2O^+$, and protonated isoprene $C_5H_9^+$, respectively. The $H_3O.H_2O^+$ signal was about 10% of the $H_3O^+$ signal, while the water cluster $H_3O^+.(H_2O)_2$ had a much lower signal and was neglected along with all other higher order water clusters.

Figure 4:
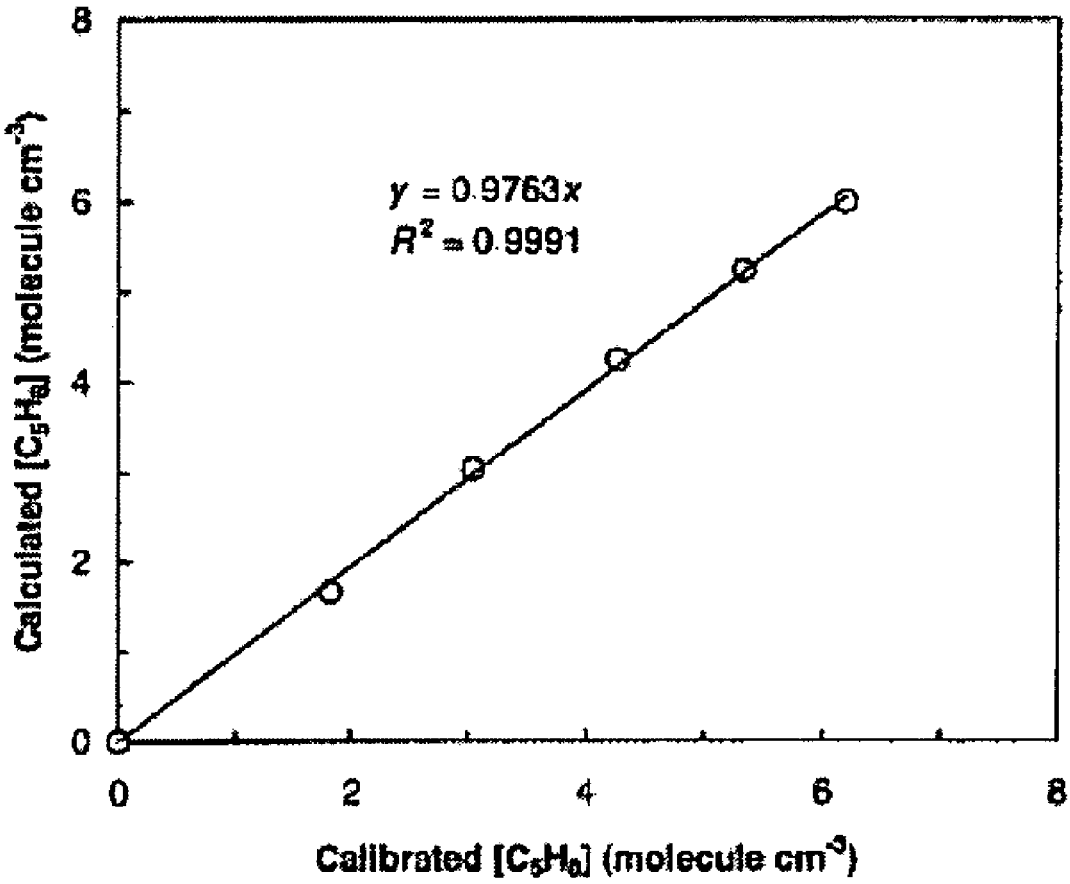
FIG. 4 illustrates a comparison of isoprene concentrations.

We conducted calibrations using volumetrically prepared samples of helium doped with 0.1% isoprene. For the ion-molecule reaction between $H_3O^+$ and isoprene, we used a value of $1.94\times10^{-9}$ $cm^3$ $molecule^{-1}$ $s^{-1}$. Using the average-dipole orientation (ADO) theory, we calculated a rate constant of $1.5\times10^{-9}$ $cm^3$ $molecule^{-1}$ $s^{-1}$ for the reaction between $H_3O.H_2O^+$ and isoprene. For isoprene calibration, the pressures were about 100 and 3 Torr in the flow tube 60 and drift tube 10, respectively. A carrier gas 90 (as shown in FIG. 2) flow of about 26 SLPM (standard liters per minute) entered the flow tube 60, and a turbulent flow condition was effectively maintained. A small isoprene sample flow (0-2 sccm, standard cubic centimeter per minute) was introduced into the flow tube 60. Air passed through the corona discharge and into the drift tube 10 at 1 SLPM. For isoprene detection, the aperture plate 95 was held at ground. FIG. 4 shows an example of isoprene calibration. The horizontal axis corresponds to isoprene concentrations determined from the known volumetric mixing ratio of the gas standard in the flow reactor, and the vertical axis represents those measured by the proton transfer mass spectrometry (PTR-MS) method according to the following equation (7):

$$[XH^+]=(k_7a[H_3O^+]+k_8b[H_3O^+.H_2O])[X]\Delta t \quad (7).$$

In equation (7), $k_7$ and $k_8$ are the reaction rate constants for $H_3O^+$ and $H_3O^+.H_2O$ with X, respectively. The fractional percentage of the entire reagent ion signal is represented by a for $H_3O^+$ and b $H_3O^+.H_2O$.equation. Δt is the ion-molecule reaction time. The other terms represent concentrations of respective neutral and ionized species.

Using an E/N ratio of about 100 Td, an agreement was achieved between the isoprene concentrations estimated from the known volumetric mixing ratio of the gas standard in the flow reactor and measured by the PTR-MS method. The correlation coefficient ($R^2$) in the isoprene calibration is within 99.9%. This comparison indicates that isoprene can be accurately quantified using equation (7). A detection limit of approximately 10 ppt (parts per trillion, 1 ppt corresponds to $2.45\times10^7$ molecule $cm^{-3}$ at 298 K and one atm) was calculated with respect to isoprene for a unity ratio of signal to noise and one second integration time.

Figure 5:
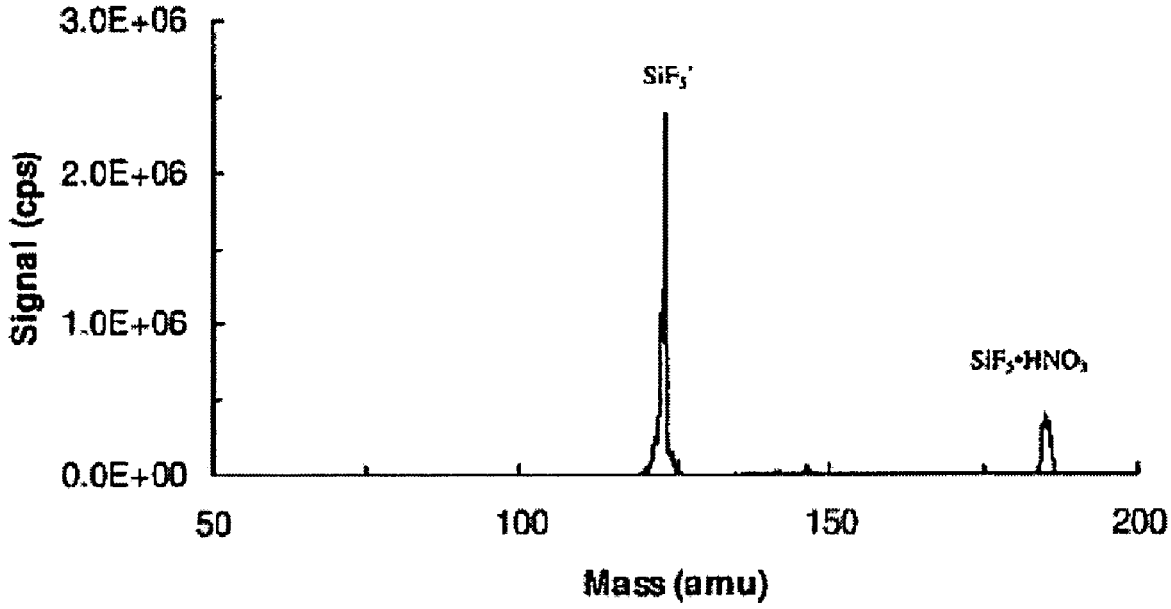
FIG. 5 illustrates a spectral scan for an $HNO_3$ analysis.
Figure 6:
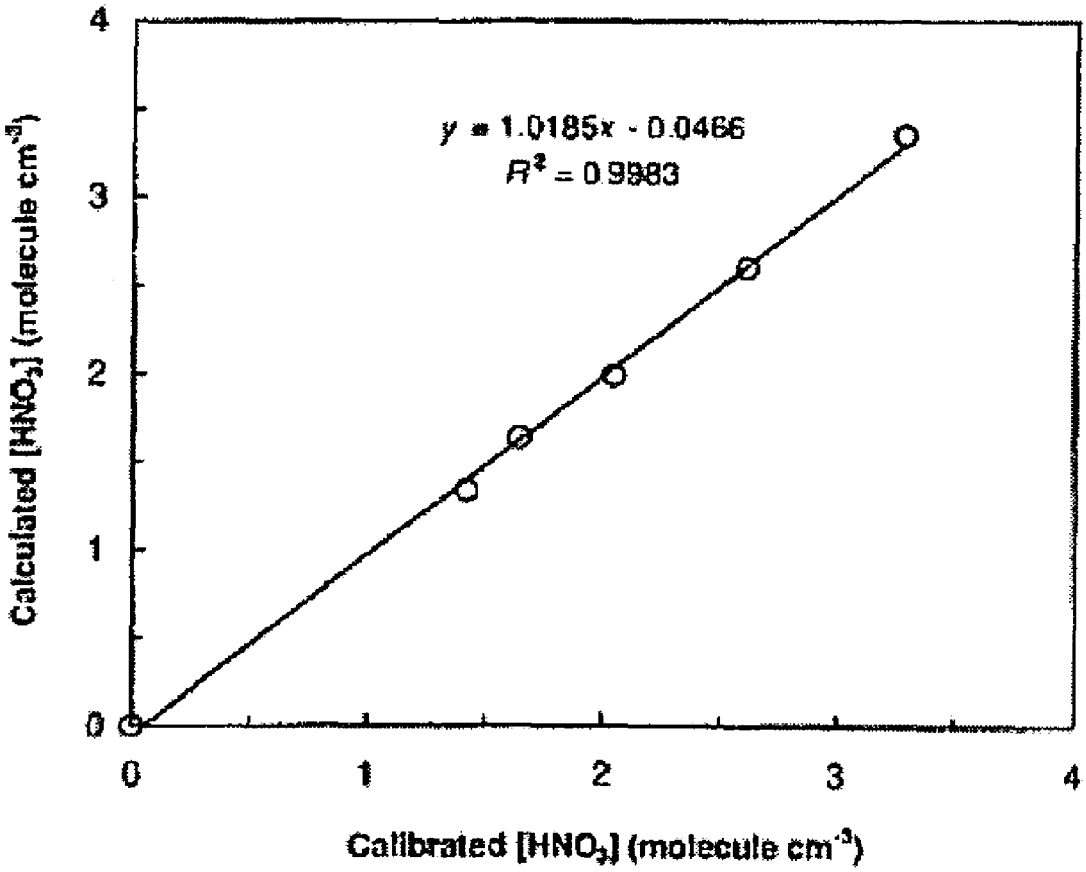
FIG. 6 illustrates a comparison of $HNO_3$ concentrations.

For $HNO_3$ detection, the drift tube 10 pressure was at about 3 Torr, and the flow tube 60 was also maintained under the turbulent flow condition. Nitrogen doped with $SF_6$ at the ppm level was passed into the drift tube 10 at a rate of 1.3 SLPM after passing through the discharge. A $N_2$ flow of 50 sccm doped with $SiF_4$ at the ppm level proceeded directly into the drift tube 10. A voltage gradient of 4.5 V/cm was applied in the drift tube 10, and the aperture 85 had a small voltage (−8 V) applied to it to assist in tuning. A spectrum of the reagent ion $SiF_5^-$ and product ion $SiF_5^-.HNO_3$ is shown in FIG. 5 when a small (~1 sccm) flow of a 0.1% $HNO_3$ in helium sample was detected by the ion drift-chemical ionization mass spectrometer. The residual signal due to $SF_6^-$ was smaller (by at least two orders of magnitude) than that the $SiF_5^-$ reagent ions, and its effect on $HNO_3$ detection was negligible. FIG. 6 shows the comparison between the $HNO_3$ concentration calculated using equation (8) (vertical axis) and that determined by the standard flow consideration knowing the mixing ratio of the $HNO_3$ sample (horizontal axis).

$$[HNO_3]=[SiF_5^-.HNO_3]/(k_{11}[SiF_5^-]\Delta t) \quad (8)$$

In equation (8), $k_{11}$ is the reaction rate constant of $HNO_3$ with $SiF_5^-$, and Δt is the ion-molecule reaction time. The other terms represent concentrations of respective neutral and ionized species. The correlation coefficient in the $HNO_3$ calibration was within 99.8%, also indicating that $HNO_3$ can be reliably quantified using equation (8). A detection limit of approximately 10 ppt was estimated with respect to $HNO_3$ for a unity ratio of signal to noise and one second integration time.

Although the present invention and its advantages have been described in detail, it should be understood that various changes, substitutions and alterations may be made herein without departing from the spirit and scope of the invention as defined by the appended claims.

What is claimed is:

1. An ion drift-chemical ionization mass spectrometer, comprising:

an ion drift zone comprising an ion conductor that transports positive or negative ions, an inlet for an analyte fluid comprising at least one neutral species, an inlet for reagent positive or negative ions, and an outlet;

an ion source that produces reagent positive or negative ions capable of chemically ionizing the at least one neutral species via chemical ionization reaction to produce product ions therefrom, wherein the ion source is in fluid communication with the inlet for reagent positive or negative ions; and a mass spectrometer in fluid communication with the outlet of the ion drift zone.

2. The ion drift-chemical ionization mass spectrometer of claim 1, wherein the ion drift zone comprises a plurality of electrodes.

3. The ion drift-chemical ionization mass spectrometer of claim 2, wherein the ion drift zone comprises at least ten electrodes.

4. The ion drift-chemical ionization mass spectrometer of claim 2, wherein the electrodes are connected in series.

5. The ion drift-chemical ionization mass spectrometer of claim 2, wherein the electrodes are parallel and isolated.

6. The ion drift-chemical ionization mass spectrometer of claim 1, further comprising a resistor disposed between the ion source and an electrode disposed in the ion drift zone.

7. The ion drift-chemical ionization mass spectrometer of claim 1, further comprising a resistor disposed between a ground and an electrode disposed in the drift zone.

8. The ion drift-chemical ionization mass spectrometer of claim 1, further comprising a resistor disposed between two electrodes, wherein the ion conductor comprises the electrodes.

9. The ion drift-chemical ionization mass spectrometer of claim 1, wherein the ion conductor creates an electric field in the ion drift zone.

10. The ion drift-chemical ionization mass spectrometer of claim 1, wherein the ion conductor comprises a voltage between about −5 kV and about 5 kV.

11. The ion drift-chemical ionization mass spectrometer of claim 1, wherein an ion and a neutral species flow though the ion drift zone.

12. The ion drift-chemical ionization mass spectrometer of claim 11, wherein the ion conductor comprises a voltage suitable for guiding the flow of the ion though the ion drift zone.

13. A method of mass spectrometry, comprising:

introducing a gas feed to an ion drift zone, wherein the gas feed comprises at least one neutral chemical species to be quantified;

providing positive or negative reagent ions to the ion drift zone, wherein the reagent ions react with the at least one neutral chemical species via chemical ionization to produce product ions therefrom;

passing the reagent ions and the product ions through an electrical field; and performing mass spectrometry on the reagent and product ions to quantify the at least one neutral chemical species of the gas feed.

14. The method of claim 13, wherein the ion drift zone comprises a plurality of electrodes.

15. The method of claim 14, wherein the plurality of electrodes provide the electrical field.

16. The method of claim 14, wherein the ion drift zone comprises at least ten electrodes.

17. The method of claim 14, wherein the electrodes are connected in series.

18. The method of claim 14, wherein the electrodes are parallel and isolated.

19. The method of claim 14, wherein the plurality of electrodes comprise a voltage between about −5V and about −5 kV.

20. The method of claim 13, further comprising providing a resistor disposed between an ion source and an electrode disposed in the ion drift zone.

21. The method of claim 13, further comprising providing a resistor disposed between a ground and an electrode disposed in the ion drift zone.

22. The method of claim 13, further comprising providing a resistor disposed between two electrodes disposed in the ion drift zone.

23. The method of claim 13, further comprising controlling a voltage of the electrical field to guide the product ions.

24. The method of claim 23, further comprising controlling the voltage to adjust a rate of reaction in the ion drift zone.

25. The method of claim 13, further comprising determining abundance of the neutral species without calibration with a gas standard.

26. The method of claim 25, further comprising determining an ion-molecule rate of reaction in the ion drift zone.

27. The method of claim 26, further comprising determining a velocity of the product ions in the ion drift zone.

28. The method of claim 13, further comprising determining whether to provide a positive or negative electrical field.

* * * * *